US007874502B2

(12) United States Patent
Harcombe et al.

(10) Patent No.: US 7,874,502 B2
(45) **Date of Patent: *Jan. 25, 2011**

(54) CONTROL VALVE ARRANGEMENT

(75) Inventors: Anthony Thomas Harcombe, Richmond (GB); Anthony John Williams, Middlesex (GB); Andy Male, Walton on Thames (GB)

(73) Assignee: Delphi Technologies Holding S.arl, Troy, MI (US)

( * ) Notice: Subject to any disclaimer, the term of this patent is extended or adjusted under 35 U.S.C. 154(b) by 505 days.

This patent is subject to a terminal disclaimer.

(21) Appl. No.: 10/520,259

(22) PCT Filed: Jun. 20, 2003

(86) PCT No.: PCT/GB03/02668

§ 371 (c)(1),
(2), (4) Date: Sep. 12, 2005

(87) PCT Pub. No.: WO2004/005702

PCT Pub. Date: Jan. 15, 2004

(65) Prior Publication Data

US 2006/0151636 A1 Jul. 13, 2006

(30) Foreign Application Priority Data

Jul. 4, 2002 (GB) ..... 0215490.4

(51) Int. Cl.
*F02M 59/00* (2006.01)

(52) U.S. Cl. ..... 239/533.3; 239/533.1; 239/533.2; 239/96; 239/124; 239/88

(58) Field of Classification Search ..... 239/569, 239/570, 96, 90, 91, 124, 127, 126, 533.1, 239/533.15, 533.11, 88, 533.2
See application file for complete search history.

(56) References Cited

U.S. PATENT DOCUMENTS 4,080,942 A 3/1978 Vincent et al.

(Continued)

FOREIGN PATENT DOCUMENTS

DE 4406901 9/1995

(Continued)

*Primary Examiner*—Len Tran
*Assistant Examiner*—Trevor E McGraw
(74) *Attorney, Agent, or Firm*—Thomas N. Twomey

(57) ABSTRACT

A control valve arrangement for use in controlling fuel pressure within a control chamber (30) includes a control valve member (32) which is movable between a first position in which the control chamber (30) communicates with a source of high pressure fuel, and a second position in which the control chamber (30) communicates with a low pressure fuel drain and communication between the control chamber (30) and the source of high pressure fuel is broken. The control valve arrangement also includes restricted flow means (55, 70, 86) for restricting the rate of flow of fuel from the control chamber (30) to the low pressure fuel drain when the control valve member (32) is moved from the first position to the second position. It is desirable for the restricted flow means to be configured and arranged such the rate of flow of fuel from the source of high pressure fuel to the low pressure drain for the period of time for which the control valve member (32) is moving between the second position and the first position is also restricted.

7 Claims, 4 Drawing Sheets

U.S. PATENT DOCUMENTS

Figure 1:
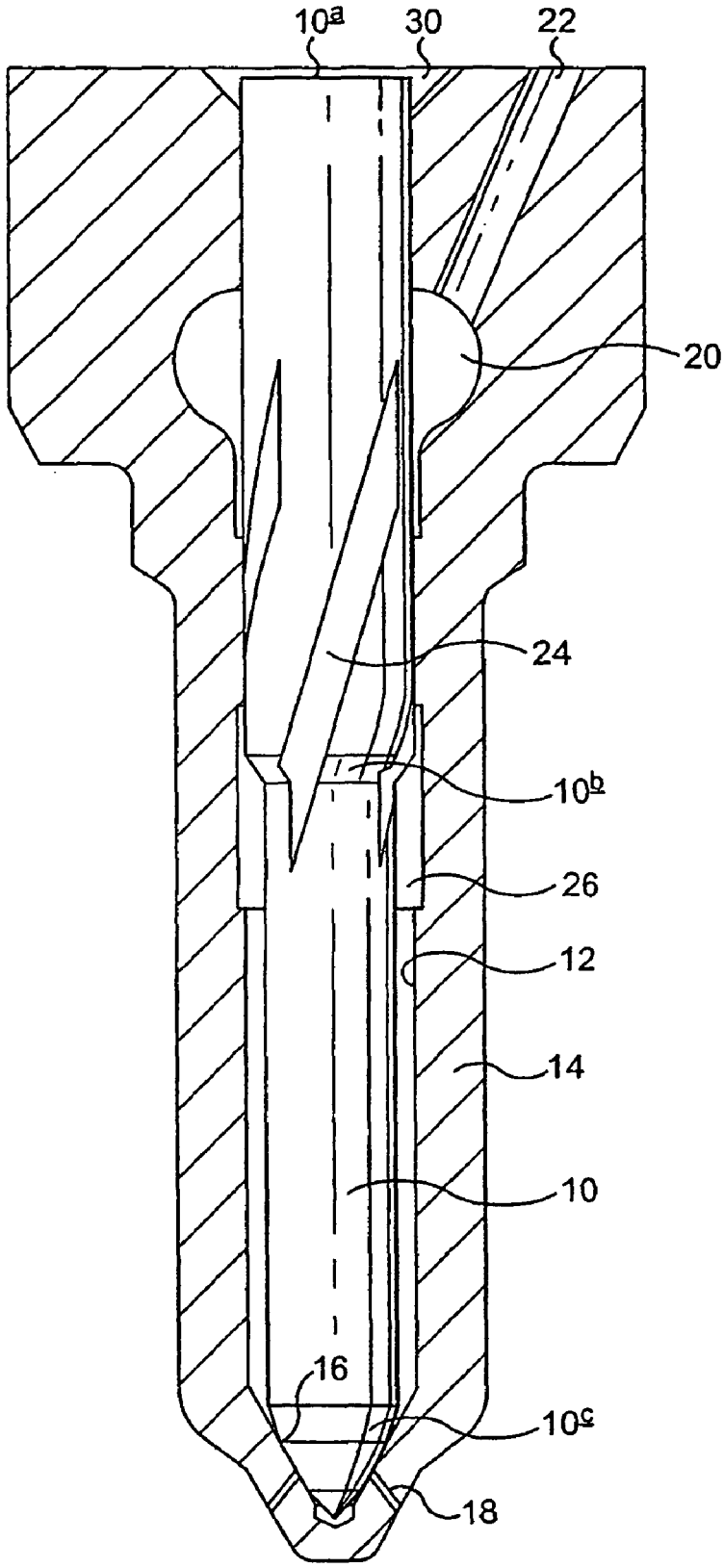
FIG. 1 PRIOR ART

| | | | | |
|---|---|---|---|---|
| 4,831,989 | A | 5/1989 | Haines | |
| 4,951,874 | A * | 8/1990 | Ohnishi et al. | 239/88 |
| 5,082,180 | A * | 1/1992 | Kubo et al. | 239/88 |
| 5,396,926 | A * | 3/1995 | Pataki et al. | 137/596.17 |
| 5,497,806 | A * | 3/1996 | Swank et al. | 137/625.65 |
| 5,524,825 | A * | 6/1996 | Ueda | 239/88 |
| 5,660,331 | A * | 8/1997 | Cooke | 239/124 |
| 5,915,623 | A * | 6/1999 | Knight et al. | 239/88 |
| 6,168,096 | B1 * | 1/2001 | Potschin et al. | 239/533.3 |
| 6,168,132 | B1 * | 1/2001 | Frank et al. | 251/33 |
| 6,199,533 | B1 * | 3/2001 | Morris et al. | 123/299 |
| 6,227,459 | B1 | 5/2001 | Coldren et al. | |
| 6,471,142 | B1 * | 10/2002 | Lambert | 239/88 |
| 6,502,555 | B1 * | 1/2003 | Harcombe et al. | 123/467 |
| 6,581,850 | B1 * | 6/2003 | Boecking et al. | 239/102.2 |
| 6,889,918 | B2 * | 5/2005 | Harcombe | 239/533.2 |
| 2005/0252490 | A1 | 11/2005 | Magel | |

FOREIGN PATENT DOCUMENTS

| | | |
|---|---|---|
| DE | 19823937 | 12/1999 |
| DE | 19940290 | 3/2001 |
| DE | 10333690 | 2/2005 |
| EP | 0992675 | 4/2000 |
| EP | 1098087 | 5/2001 |
| EP | 1245822 | 10/2002 |
| GB | 2213238 | 8/1989 |
| GB | 2296076 | 6/1996 |
| GB | 2353564 | 2/2001 |
| JP | 2002-174159 | 6/2002 |
| WO | WO 93/23667 | 11/1993 |
| WO | WO03/004856 | 1/2003 |
| WO | WO2004/005702 | 1/2004 |

* cited by examiner

CONTROL VALVE ARRANGEMENT

This invention relates to a control valve arrangement for use in controlling fluid pressure within a control chamber. In particular, the invention relates to a control valve arrangement for use in controlling fluid pressure within a control chamber forming part of a fuel injector for use in the delivery of fuel to a combustion space of an internal combustion engine.

It is known to provide a fuel injector with a control valve arrangement which is arranged to control movement of a fuel injector valve needle relative to a seating so as to control the delivery of fuel from the injector. Movement of the valve needle away from the seating permits fuel to flow from an injector delivery chamber through an outlet of the injector into the engine cylinder or other combustion space.

The control valve arrangement includes a control valve member which is movable between a first position, in which fuel under high pressure is able to flow into the control chamber, and a second position in which the control chamber communicates with a low pressure fuel reservoir. A surface associated with the valve needle is exposed to fuel pressure within the control chamber such that the pressure of fuel within the control chamber applies a force to the valve needle to urge the valve needle against its seating.

In order to commence injection, the valve arrangement is actuated such that the control valve member is moved into its second position, thereby causing fuel pressure within the control chamber to be reduced. The force urging the valve needle against its seating is therefore reduced and fuel pressure within the delivery chamber serves to lift the valve needle away from its seating to permit fuel to flow through the injector outlet. In order to terminate injection, the valve arrangement is actuated such that the control valve member is moved into its first position, thereby permitting fuel under high pressure to flow into the control chamber. The force acting on the valve needle due to fuel pressure within the control chamber is therefore increased, causing the valve needle to be urged against its seating to terminate injection.

For optimal injector performance, it is desired to control the rate at which the valve needle of the injector lifts so as to provide a controlled increase in injection rate. However, it is also desired to terminate injection rapidly.

It is known to provide a restricted flow path so that the rate of flow of fuel between the source of high pressure fuel and the control chamber is restricted. This alleviates the problem of unbalanced hydraulic forces acting on the control valve member as a result of the flow of fuel past the valve seat. Such unbalanced forces can cause the valve needle of the injector to 'dither between injecting and non-injecting positions, and this has a detrimental effect on injector performance.

A disadvantage of this restricted flow path is that it slows down the rate at which the control chamber is pressurized, and therefore the rate at which the valve needle of the injector is urged against its seating to terminate injection. Furthermore, depressurization of the control chamber can occur rapidly, giving rise to relatively fast valve needle lift. Such characteristics are not considered to provide optimal injector performance.

It is an object of the present invention to provide a control valve arrangement suitable for use in a fuel injector, which enables an improved injection characteristic to be achieved.

According to a first aspect of the present invention there is provided a control valve arrangement for use in controlling fuel pressure within a control chamber, the control valve arrangement including a control valve member which is movable between a first position in which the control chamber communicates with a source of high pressure fuel and a second position in which the control chamber communicates with a low pressure fuel drain and communication between the control chamber and the source of high pressure fuel is broken, and restricted flow means for restricting the rate of flow of fuel from the control chamber to the low pressure fuel drain when the control valve member is moved from the first position to the second position.

The control valve arrangement has particular application in a fuel injector, and may be arranged to control fuel pressure within a control chamber associated with an injector valve needle so as to control movement of the valve needle towards and away from a valve needle seating for the purpose of controlling injection.

One advantage is that the restricted flow from the control chamber to the low pressure drain results in a slower decrease in pressure within the control chamber. As a result, the speed with which the valve needle of the injector lifts away from its seating is slower and can be determined by selection of a suitable size of restriction.

Preferably, the restricted flow means is further operable for restricting the rate of flow of fuel from the source of high pressure fuel to the low pressure drain when the control valve member is being moved between the second position and the first position. This provides the advantage that, during the relatively brief period when the control valve arrangement is being switched between its first and second positions, the flow of fuel between the high pressure source and the low pressure drain is restricted so as to minimize parasitic fuel losses.

In a more preferred embodiment, the restricted flow means is arranged so that fuel flow rate out of the control chamber to the low pressure drain is relatively low whereas the fuel flow rate into the control chamber from the high pressure fuel source is relatively high. Thus, the rate of flow of fuel into the control chamber to terminate injection is substantially unaffected by the restricted flow means and so termination of injection can be achieved rapidly, providing asymmetric needle lift and closure rates.

The rate of flow of fuel through the control valve arrangement as the control valve member is moved is determined by the pressure difference between the high pressure source and the low pressure drain, and by the size of any restriction to flow. The unbalanced hydraulic forces which give rise to the aforementioned dithering problem are caused by a high rate of flow of fuel in this condition. The present arrangement overcomes the "dithering" problem at the same time as providing a slower, more controlled lifting of the valve needle in the injector for optimal injector performance. The invention therefore also permits more accurate control over the injection of low delivery flows at small values of needle lift.

In a preferred embodiment, the valve member engages with a first seating when in the first position and with a second seating when in the second position.

In one embodiment, the first seating is defined by a surface of a bore provided in a valve housing within which the valve member is movable. The second seating may also be defined by surface of the bore provided in the valve housing.

The restricted flow means may comprise a restricted flow passage defined by an outer surface of the valve member and the bore in the valve housing. In one embodiment, the restricted flow passage is located between the first seating and the second seating.

Conveniently, the valve member and the valve housing together define a flow passage between the first seating and the second seating, wherein the flow passage is provided with the restricted flow means upstream of the first seating, said restricted flow means preferably taking the form of a restricted clearance between a bore in the valve housing and an outer surface of the valve member.

The valve member may be shaped such that the restricted passage is defined by control flats, slots or grooves on the outer surface of the valve member, together with the bore in the valve housing.

In an alternative embodiment, the restricted flow means is arranged downstream of the first seating, in between the first seating and the low pressure drain.

In an alternative embodiment, the restricted flow means may be defined by an orifice or restricted drilling provided in the valve member. The orifice or restricted drilling may be provided in a region of the valve member downstream of the first seating.

The bore in the valve housing may be provided with a sleeve or insert member, wherein the sleeve defines the first seating and/or the second seating.

The valve member may be provided with a collar having a slideable fit within a sleeve bore and may be shaped to define a recess between the first seating and the collar. The collar may be integrally formed with the valve member, or may be a separate part carried by the valve member. Preferably, the orifice in the valve member may open into the recess.

A particular benefit of this embodiment is that the size of the restriction to flow depends upon the size of a single machine operation (the formation of the drilling defining the orifice).

In an alternative preferred embodiment, the control valve arrangement includes a by pass flow means arranged within the control chamber. Preferably the by pass flow means includes a plate valve arrangement including a plate valve member provided with a control orifice extending there through. Preferably, a wall of the control chamber defines a plate valve seating, whereby the plate valve member is moveable against the plate valve seating by means of fuel pressure within the control chamber, so as to ensure the flow of fuel from the control chamber flows through the control orifice when the plate valve member is engaged with the plate valve seating.

Preferably, the control chamber is shaped to define a bypass flow passage around the plate valve member, whereby a substantially unrestricted flow of fuel can enter the control chamber when the plate valve member is urged away from the plate valve seating.

According to a second aspect of the present invention there is provided a fuel injector for use in delivering fuel to an internal combustion engine comprising a valve needle which is engageable with a valve needle seating, in use, to control fuel delivery through an outlet opening, a surface associated with the valve needle being exposed to fuel pressure within a control chamber, and a control valve arrangement for controlling fuel pressure within the control chamber as hereinbefore described in accordance with the invention.

Preferably, when the control valve member is in its first position, the valve needle is seated against the valve needle seating due to high fuel pressure within the control chamber, such that fuel injection does not occur.

According to a third aspect of the present invention there is provided a fuel injection system for an internal combustion engine comprising a fuel injector as hereinbefore described in accordance with the invention.

According to a fourth aspect of the present invention, there is provided a fuel injector for use in delivering fuel to an internal combustion engine, the fuel injector comprising a valve needle which is engageable with a valve needle seating, in use, to control fuel delivery through an outlet opening, a surface associated with the valve needle being exposed to fuel pressure within a control chamber, a control valve arrangement for controlling fuel pressure within the control chamber so as to control fuel injection and a further valve arrangement which is operable in response to fuel pressure within the control chamber so as to permit a restricted flow of fuel out of the control chamber during valve needle lift and an increased flow of fuel into the control chamber during pressurization of the control chamber to terminate injection.

It will be appreciated that the preferred and/or optional features of the first aspect of the invention may also be incorporated in the other aspects of the invention.

Figure 2:
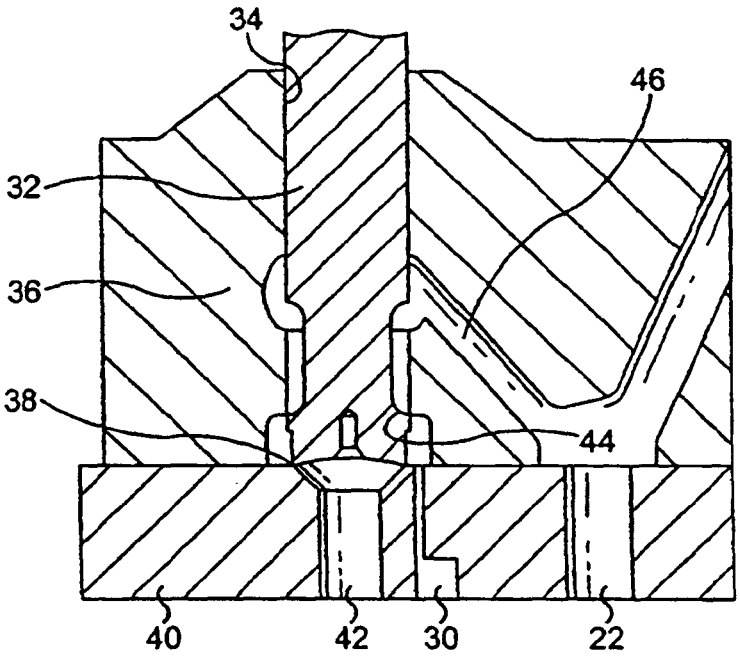
FIG. 2 PRIOR ART
Figure 3:
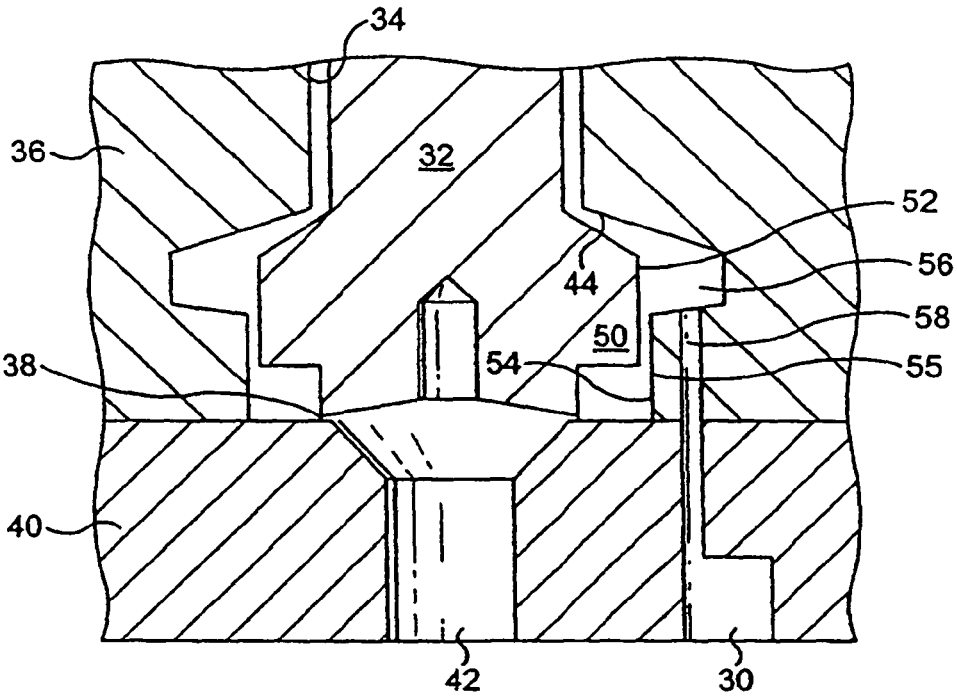
Figure 4:
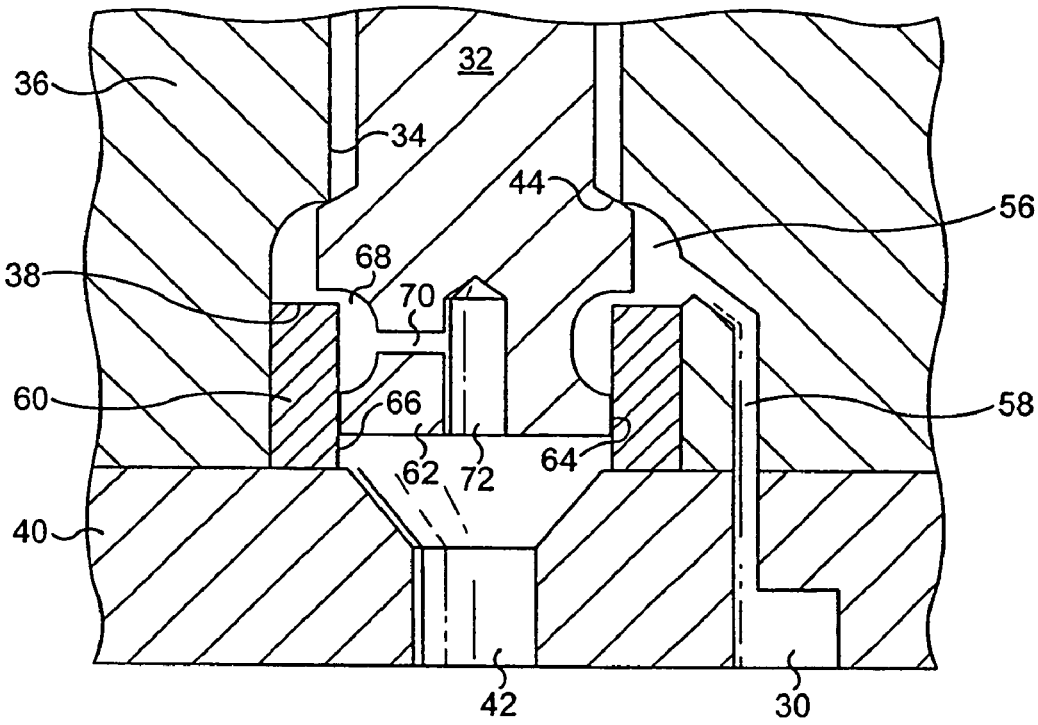
Figure 5:
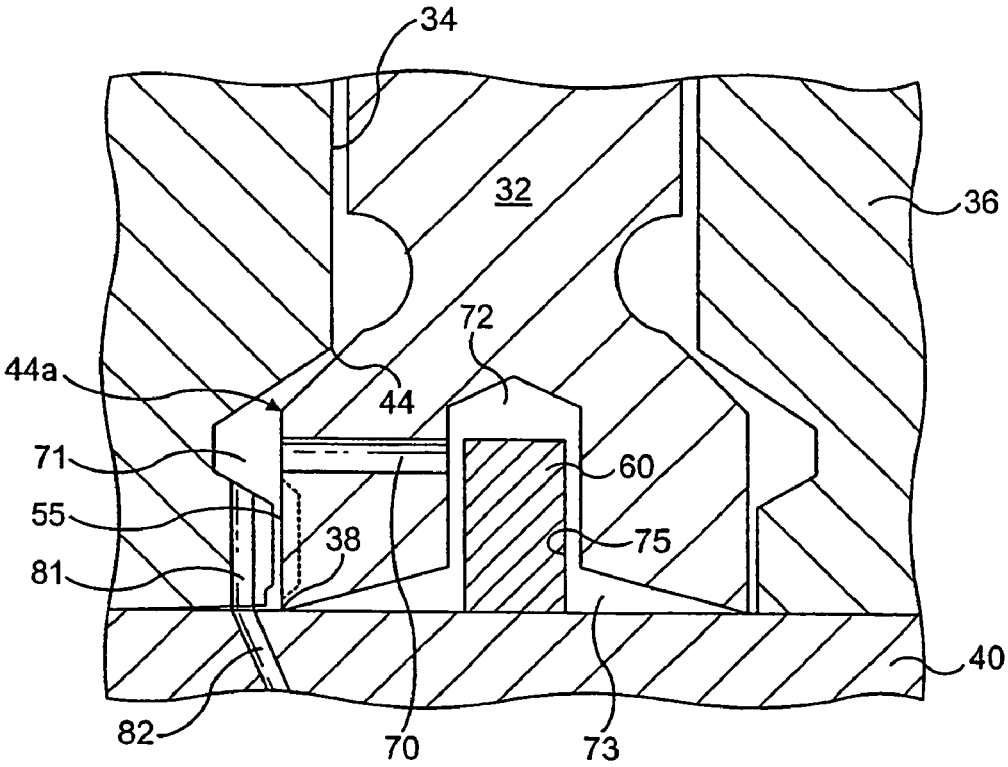
Figure 6:
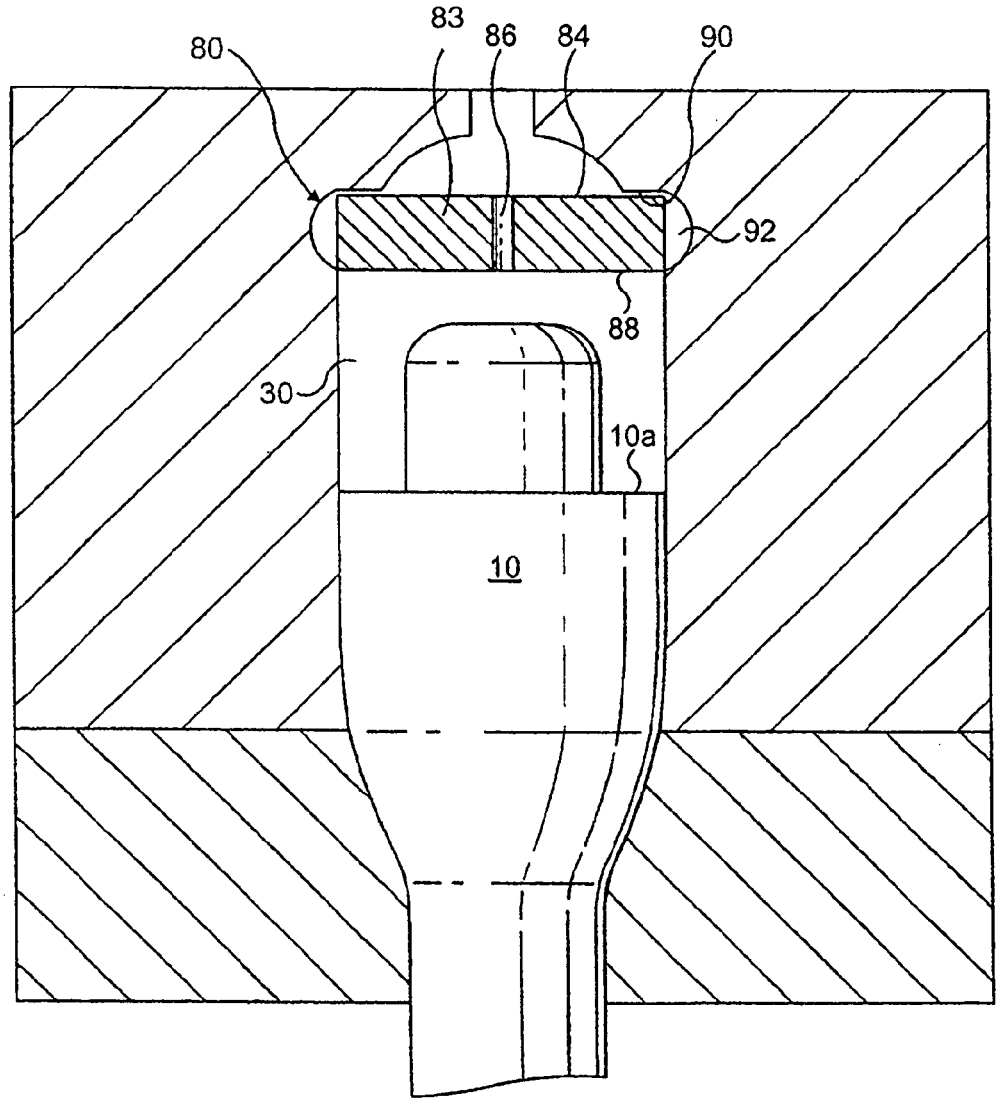

The invention will be described, by way of example, with reference to the accompanying drawings, in which:

FIG. 1 is a sectional view of a known fuel injector which may be provided with the control valve arrangement of the present invention, FIG. 2 is a sectional view of a known control valve arrangement for use in the injector in FIG. 1, FIG. 3 is a sectional view of part of a control valve arrangement forming part of a first embodiment of the invention, FIG. 4 is a sectional view of part of a control valve arrangement forming part of a second embodiment of the invention, FIG. 5 is a sectional view of a part of a control valve arrangement forming part of a third embodiment of the invention, and FIG. 6 is a sectional view of part of a control valve arrangement forming part of a fourth embodiment of the invention.

Referring to FIG. 1, a fuel injector for use in delivering fuel to an engine cylinder or other combustion space of an internal combustion engine comprises a valve needle 10 which is slidable within a bore 12 provided in a nozzle body 14. The valve needle 10 is engageable with a valve needle seating 16 defined by the bore 12 so as to control fuel delivery through a set of outlet openings 18 provided in the nozzle body 14. The bore 12 is shaped to define an annular chamber 20 to which fuel under high pressure is delivered, in use, through a supply passage 22 provided in the nozzle body 14. Fuel delivered to the annular chamber 20 is able to flow through flats, grooves or flutes 24 provided on the surface of the valve needle 10 into a delivery chamber 26 defined between the valve needle 10 and the bore 12.

At the end of the valve needle 10 remote from the outlet openings 18, the end surface 10*a* of the valve needle 10 is exposed to fuel pressure within a control chamber 30. Fuel pressure within the control chamber 30 applies a force to the valve needle 10 which serves to urge the valve needle 10 against the valve needle seating 16 to prevent fuel injection through the outlet openings 18. In use, with high pressure fuel supplied to the annular chamber 20 through the supply passage 22 and, hence, to the delivery chamber 26, a force is applied to thrust surfaces 10*b* 10*c* of the valve needle 10 which serves to urge the valve needle 10 away from the valve needle seating 16. If fuel pressure within the control chamber 30 is reduced sufficiently, the force acting on the thrust surfaces 10*b*, 10*c* due to fuel pressure within the delivery chamber 26 is sufficient to overcome the force acting on the end surface 10*a* of the valve needle 10, such that the valve needle 10 lifts away from the valve needle seating 16 to commence fuel injection. Thus, by controlling fuel pressure within the control chamber 30, initiation and termination of fuel injection can be controlled.

The pressure of fuel within the control chamber 30 may be controlled by means of the control valve arrangement, as shown in FIG. 2. The control valve arrangement includes a control valve member 32 which is slidable within a further bore 34 defined in a valve housing 36. The valve housing 36 is in abutment with a further housing 40 within which the control chamber 30 is defined, at least in part. The further housing 40 is provided with a drilling which defines a flow passage 42 in communication with a low pressure fuel reservoir or drain.

The end face of the further housing 40 defines a first seating 38 with which an end of the control valve member 32 is engaged when the control valve member 32 is moved into a first position. The further bore 34 is shaped to define a second seating 44 with which a surface of the control valve member 32 is engaged when the control valve member 32 is moved into a second position. Conveniently, the control valve member 32 is biased into engagement with the first seating 38 by means of a spring (not shown) or other biasing means. Movement of the control valve member 32 may be controlled by means of an electromagnetic actuator arrangement or a piezoelectric actuator arrangement in a conventional manner.

It will be appreciated that the high pressure supply passage 22 is defined by drillings provided in various housing parts (e.g. 14 in FIG. 1, 40 in FIG. 2).

In use, with the control valve member 32 in its first position such that the end of the control valve member 32 is in engagement with the first seating 38, fuel at high pressure is able to flow from the supply passage 22 through an intermediate flow passage 46 defined in the valve housing 36, past the second seating 44 and into the control chamber 30. In such circumstances, fuel pressure within the control chamber 30 is relatively high such that the valve needle 10 is urged against the valve needle seating 16. Thus, fuel injection through the outlet openings 18 does not occur. The control valve member 32 is shaped such that a flow path of relatively large diameter exists for fuel flowing through the intermediate flow passage 46, past the second seating 44 and into the control chamber 30 when the control valve member 32 is seated against the first seating 38.

When the control valve member 32 is moved away from the first seating 38 into engagement with the second seating 44, fuel within the supply passage 22 is no longer able to flow past the second seating 44 and fuel within the control chamber 30 is able to flow past the first seating 38 and through the flow passage 42 to the low pressure fuel reservoir. Fuel pressure within the control chamber 30 is therefore reduced. As a result, the valve needle 10 is urged away from the valve needle seating 16 due to the force of fuel pressure within the delivery chamber 26 acting on the thrust surfaces 10*b* and 10*c* of the valve needle being sufficient to overcome the reduced force acting on the end surface 10*a* of the valve needle 10.

Referring to FIG. 3, in which equivalent features have the same reference numerals as those of FIG. 2, the valve member 32 is provided with a portion 50, located between the first seating 38 and the second seating 44, having a cylindrical outer surface 52. The further bore 34 in the valve housing 36 includes a portion between the first seating 38 and the second seating 44 having an internal cylindrical surface 54. The cylindrical surface 52 of the valve member 32 and the cylindrical surface 54 of the bore 34 together define a restricted flow passage or path 55 between the first seating 38 and second seating 44. The control chamber 30 communicates, via an extended passage 58 provided in the housings 36,40, with an annular gallery 56 defined within the further bore 34. The diameter of the bore 34 is substantially identical to the diameter of the first seating 38, due to the "cut away" portion of the valve member 32 at its lower end.

In use, when the valve member 32 is in engagement with the first seating 38, spaced away from the second seating 44, the control chamber 30 is in communication with high pressure fuel, and the valve needle 10 of the injector is urged against the injector seating 16. When the valve member 32 is lifted away from the first seating 38 and moves towards the second seating 44, high pressure fuel flows through the extended passage 58, into the gallery 56 and through the restricted flow passage 55 to the low pressure drain, and a point will be reached at which pressure in the control chamber 30 is relieved sufficiently to permit the valve needle 10 to lift. The restricted flow of fuel through the restricted passage 55 during valve needle lift causes the pressure in the control chamber 30 to fall more slowly than in the prior art arrangements, giving rise to a slower opening of the valve needle 10 of the injector.

When the valve member 32 is moved back into engagement with the first seating 38, the pressure of fuel in the control chamber 30 rises rapidly as the flow of high pressure fuel into the control chamber 30 does not pass through the restricted passage 55. Termination of injection is therefore rapid as the pressure in the control chamber 30 urges the valve needle 10 of the injector against its seating 16.

As the valve member 32 moves between its second position (engagement with the second seating 44) and its first position (engagement with the first seating 38), any flow of high pressure fuel past the second seating 44 to low pressure is restricted by the restricted flow passage 55. In known arrangements, while the valve member 32 is moving between these positions, the rate of flow of fuel is determined by the pressure difference between the high pressure supply (through 34) and the low pressure drain (through 42) and the unbalanced hydraulic forces which give rise to the aforementioned "dithering" problem are caused by a high rate of flow of fuel to low pressure. The "dithering" problem is overcome by the present arrangement as the rate of flow of high pressure fuel to low pressure as the valve member 32 is moving from its second seating 44 to its first seating 38 is restricted by means of the passage 55. At the same time, however, the benefits of a rapid termination of injection can also be achieved. This is another advantage of the present invention, as the flow rate of high pressure fuel out of the control chamber 30 to low pressure so as to lift the valve needle is relatively low due to the restricted passage 55, whereas the flow rate of fuel into the control chamber 30 to terminate injection is relatively high, as the flow rate to terminate injection is not hindered by the restricted passage 55. The valve needle therefore has an asymmetry in its rate of opening and rate of closing movement.

As a slight modification, the valve member 32 may be provided with flats, slots or grooves on its outer surface to define the restricted flow passage for fuel between the control chamber and the low pressure drain during needle lift.

For low values of needle lift (i.e. when the valve member is at or near the first seating 38), the hydraulic forces acting on the valve member 32 are substantially balanced, but for intermediate values of needle lift, as the valve member 32 is moving between its first seating 38 and its second seating 44, there will be a force imbalance acting on the valve member 32 as the control pressure due to flow from the control chamber 30 is still relatively high. At or near full needle lift, with the valve member 32 at or near the point of engagement with its second seating 44, control pressure is substantially reduced and the valve member 32 is balanced once again. As a result of the flow-dependent imbalance of forces acting on the valve member 32, movement of the valve member 32 will be slowed as it approaches the second seating 44. As it approaches the first seating 38 to terminate injection, the rate of movement of the valve member 32 will be increased. This asymmetry is a desirable characteristic.

Referring to FIG. 4, in which equivalent features have the same reference numerals as those of FIGS. 2 and 3, an alternative arrangement is shown in which the first seating 38 is defined by an end face of a sleeve 60 or "floating seat" inserted into the bore 34 of the housing 36. A lower portion 62 of the valve member 32 is provided with a collar 64, having an outer cylindrical surface, which forms a slidable fit within a bore 66 of the sleeve 60. The valve member 32 is also shaped to define an annular recess 68, located upstream of the collar 64, in fluid communication with the low pressure drain passage 42 via an orifice 70 and a blind drilling 72 provided in the lower region 62 of the valve member 32. The orifice 70 has a diameter, which is selected to provide a restriction to fuel flow therethrough.

As shown in FIG. 4, when the valve member 32 is in the second position in which it engages the second seating 44, the control chamber 30 is in fluid communication with the low pressure drain so that fuel can flow past the first seating 38 into the recess 68, through the orifice 70 and the drilling 72 to the low pressure drain 42. The orifice 70 therefore provides the same flow restricting effect as the restricted passage 55 of the embodiment of FIG. 3, resulting in a slower fall of pressure in the control chamber 30 as the valve member 32 is moved from its first position (engagement with the first seating 38) into its second position (engagement with the second seating 44).

Similarly, when the valve member 32 is moved out of engagement with the second seating 44, the pressure of fuel within the control chamber 30 rises rapidly. While the valve member 32 moves between the second seating 44 and the first seating 38, and just prior to the valve member 32 seating against the first seating, the flow of high pressure fuel past the second seating 44 is restricted by the orifice 70 to avoid or reduce the problem of dithering.

FIG. 5 shows a further alternative embodiment to that shown in FIGS. 3 and 4. In this embodiment, the first seating 38 for the valve member 32 is of greater diameter than the diameter of the bore 34 defining the second seating 44 but is the same as the diameter of the valve member 32 at an outer radial edge 44*a* of the seatable surface of valve member 32. The valve arrangement also includes a force balance arrangement including a balance piston 60 received within a blind drilling 75 provided in the lower end of the valve member 32. The blind drilling 75 defines, at one end thereof, a blind end space or volume 72 which communicates, through a radially extending drilling 70, with an annular chamber 71 defined by an enlarged region of the bore 34. The other end of the drilling 72 opens into a further space 73. The annular chamber 71 communicates with the control chamber 30 through drillings 81, 82 provided in various housing parts.

As described previously with reference to FIG. 3, the outer surface of the lower end of the valve member 32 and the bore 34 in the valve housing 36 together define a restricted flow passage 55 which serves to restrict the rate of flow of fuel between the control chamber and the low pressure drain when the valve member 32 is moved away from the first seating 38. Alternatively, the valve member 32 may be provided with control flats (as illustrated in dashed lines) on its outer surface to define the restricted flow passage.

In use, as the valve member 32 is biased away from the second seating 44, into engagement with the first seating 38, the seatable surface of the valve member 32 is exposed to high pressure fuel flow between the supply passage 22 and the control chamber 30. In the absence of the force balance arrangement 60, 72, 70, 75, this exposed surface of the valve member 32 would experience a force due to hydraulic pressure that would tend to aid movement of the valve member 32 towards the first seating 38. However, due to the provision of the force balance arrangement 60, 72, 70, 75, as the valve member 32 is moved away from the seating 44 fuel is able to flow into the volume 72 through the drilling 70. The force balance arrangement is dimensioned such that the hydraulic forces acting on the valve member 32 within the volume 72 tends to balance the out of balance force acting on the exposed valve surface.

During movement of the valve member 32 between the second and first seatings 44, 38 to seat the valve needle, the hydraulic forces acting on the valve member 32 are therefore substantially balanced. Although not clearly shown in FIG. 5, the balance piston 60 should be dimensioned to be a relatively tight fit within the drilling 72 so as to minimize fuel leakage loss to low pressure during termination of injection. Referring to FIG. 6, in another embodiment the control chamber 30 includes a plate valve arrangement 80 which is operable in response to fuel pressure within the control chamber 30. The plate valve arrangement 80 may be provided in combination with the control valve arrangement of FIG. 2, or in combination with the control valve arrangement of FIG. 3 or 4. The plate valve arrangement 80 has a plate valve member 83 having first and second end faces 84, 88 and a control orifice 86 extending through the plate valve member 83 between the end faces 84, 88. The wall of the control chamber 30 is shaped to define a plate valve seating 90 for the first end face 84 of the plate valve member 83, and an annular recess defining a bypass flow passage 92 around the plate valve member 83. Although not shown in FIG. 6, the plate valve arrangement may be provided with a spring to bias the plate valve member 83 towards the plate valve seating 90.

In use, when the control valve member 32 of FIG. 2 is seated against the first seating 38, fuel pressure within the control chamber 30 is high and the valve needle 10 of the injector is seated. When the control valve member 32 is lifted away from the first seating 38, the control chamber 30 is brought into communication with the low pressure drain passage 42. The pressure of fuel in the control chamber 30 serves to urge the plate valve member 83 against the plate valve seating 90 so that fuel can only escape from the control chamber through the control orifice 86 in the plate valve member 83 at a controlled rate. This results in a slower lifting of the injector valve needle 10 away from its seating 16.

When the control valve member 32 is moved away from the second seating 44 back towards the first seating 38, high pressure fuel is able to flow into the control chamber 30. As high pressure fuel is re-established within the control chamber 30. the plate valve member 83 is urged away from the plate valve seating 90 to permit a rapid flow of high pressure fuel around the plate valve member 83 through the bypass flow passage 92, thereby imparting a hydraulic force to the back end of the valve needle 10. The provision of the plate valve arrangement therefore enables rapid re-pressurization of the control chamber 30 when injection is to be terminated. Thus, rapid closure of the injector valve needle 10 can be achieved.

In an alternative embodiment to that shown in FIG. 6, the plate valve member 83 may be replaced by an alternative fixed part provided with a control orifice 86 having an inlet end in communication with the path from the valve (i.e. valve member 32 in FIGS. 3 to 6) and an outlet end in communication with the control chamber 30. The inlet end of the control orifice 86 is radiused or bell or trumpet mouthed, and the outlet end is sharp edged such that there is a greater restriction to the fuel flow rate out of the control chamber 30 than into the control chamber 30. This embodiment also therefore provides an asymmetric needle lift characteristic, as described previously for the embodiments of FIGS. 3 to 6. The alternative part which replaces the plate valve member 83 of FIG. 6 may be a separate component, or may form part of the housing defining the walls of the control chamber 30.

The invention claimed is:

1. A control valve arrangement for use in controlling fuel pressure within a control chamber of a fuel injector thereby to control the movement of an injector valve needle relative to an injector valve seating wherein, in use, a portion of the injector valve needle is exposed to fuel pressure within the control chamber, the control valve arrangement including:

a control valve member that is movable between a first position and a second position, wherein, in the first position, the control valve member engages a first seating such that the control chamber communicates with a source of high pressure fuel and communication between the control chamber and a low pressure fuel drain is prevented thereby urging the injector valve needle against the injector valve needle seating, and wherein in the second position the control valve member engages a second seating such that the control chamber communicates with the low pressure fuel drain and communication between the control chamber and the source of high pressure fuel is broken thereby causing the injector valve needle to lift away from the injector valve needle seating, wherein the second seating is defined by a surface of a bore provided in a valve housing within which the control valve member is movable; and a restricted flow path for:

i) restricting the rate of flow of fuel from the control chamber to the low pressure fuel drain when the control valve member is moved from the first position to the second position, thereby reducing the speed at which the injector valve needle lifts from the injector valve needle seating; and ii) restricting the rate of fuel flow from the source of high pressure fuel to the low pressure fuel drain when the control valve member is moved from the second position to the first position to urge the injector valve needle against the injector valve needle seating while reducing the loss of high pressure fuel to low pressure, wherein the restricted flow path comprises a restricted flow passage being located between the first seating and the second seating and defined by an outer surface of the control valve member and the bore in the valve housing.

2. A control valve arrangement as claimed in claim 1, wherein the restricted flow path is arranged so that fuel flow rate out of the control chamber to the low pressure drain is relatively low whereas the fuel flow rate into the control chamber is relatively high, thereby providing asymmetric control valve operation.

3. A control valve arrangement as claimed in claim 1, wherein the control valve member is movable within the bore provided in the valve housing and wherein an insert is arranged within the bore in the valve housing to define the first seating.

4. A control valve arrangement as claimed in claim 1, wherein the restricted flow path is arranged upstream of the first seating and downstream of the second seating.

5. A control valve arrangement as claimed in claim 1, wherein the restricted flow path is defined by an orifice provided in the control valve member.

6. A fuel injector for use in delivering fuel to an internal combustion engine, the fuel injector comprising:

a valve needle that is engageable with a valve needle seating, in use, to control fuel delivery through an outlet opening, a surface associated with the valve needle being exposed to fuel pressure within a control chamber, and a control valve arrangement for controlling fuel pressure within the control chamber, the valve arrangement including:

a control valve member that is movable between a first position to engage a first seating in which the control chamber communicates with a source of high pressure fuel and communication between the control chamber and a low pressure fuel drain is prevented thereby urging the injector valve needle against the injector valve needle seating, and a second position to engage a second seating in which the control chamber communicates with a low pressure fuel drain, and communication between the control chamber and the source of high pressure fuel is broken, thereby causing the injector valve needle to lift away from the injector valve needle seating, wherein the second seating is defined by a surface of a bore provided in a valve housing within which the control valve member is movable; and a restricted flow path for restricting the rate of flow of fuel from the control chamber to the low pressure fuel drain when the control valve member is moved from the first position to the second position, thereby reducing the speed at which the injector valve needle lifts from the injector valve needle seating and restricting the rate of fuel flow from the source of high pressure fuel to the low pressure fuel drain when the control valve member is moved from the second position to the first position to urge the injector valve needle against the injector valve needle seating while reducing the loss of high pressure fuel to low pressure, wherein the restricted flow path comprises a restricted flow passage being located between the first seating and the second seating and defined by an outer surface of the control valve member and the bore in the valve housing.

7. A fuel injection system for an internal combustion engine comprising a fuel injector for use in delivering fuel to an internal combustion engine, the fuel injector comprising a valve needle that is engageable with a valve needle seating, in use, to control fuel delivery through an outlet opening, a surface associated with the valve needle being exposed to fuel pressure within a control chamber, and a control valve arrangement as claimed in claim 1 for controlling fuel pressure within the control chamber.

* * * * *